US005382091A

United States Patent [19]

Roff, Jr.

[11] Patent Number: 5,382,091

[45] Date of Patent: Jan. 17, 1995

[54] BARITE SCRUBBER MUD TANK

[76] Inventor: John W. Roff, Jr., P.O. Box 881-7, Conroe, Tex. 77305

[21] Appl. No.: 198,030

[22] Filed: Feb. 17, 1994

[51] Int. Cl.[6] ..... B01F 7/00

[52] U.S. Cl. ..... 366/186; 366/194; 366/292; 210/523

[58] Field of Search ..... 366/154, 155, 186, 292, 366/295, 279, 299, 300, 69, 65, 194; 210/521, 523, 532.1

[56] References Cited

U.S. PATENT DOCUMENTS 732,735 7/1903 Graves ..... 366/300

5,046,856 9/1991 McIntire ..... 366/297

5,061,375 10/1991 Dyler ..... 210/532.1

5,294,408 3/1994 Muzik ..... 210/523

*Primary Examiner*—Robert W. Jenkins

*Attorney, Agent, or Firm*—David M. Ostfeld

[57] ABSTRACT

A scrubber for processing barite contained in drilling mud is disclosed. The scrubber includes a tank mounted above ground and has an inlet and outlet for the mud and a second outlet for heavier material that settles out from the mud. A set of blade agitators maintain the flow of the mud while a set of paddle wheel agitators concentrate and convey the heavier materials.

16 Claims, 1 Drawing Sheet

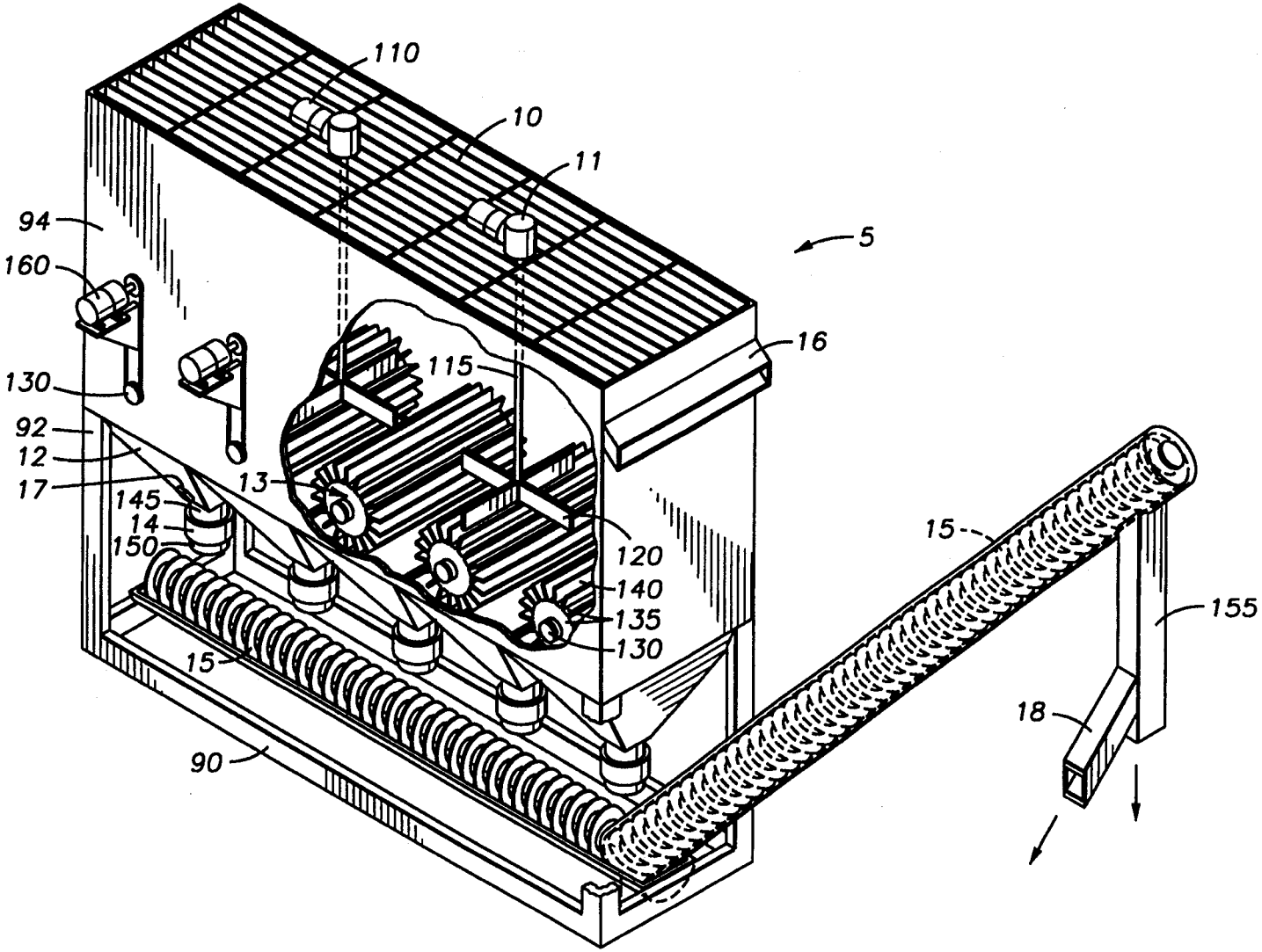
5
16
155
18
15
11
10
110
120
140
135
130
115
13
145
14
150
15
90
94
160
130
92
12
17

BARITE SCRUBBER MUD TANK

FIELD OF THE INVENTION

This invention relates to drilling mud processing and more particularly to barite extraction from drilling muds.

BACKGROUND OF THE INVENTION

In the drilling of oil wells, the use of mud in the operations of the drilling have been known for many years. The return of this mud from the hole where the drilling occurs includes cuttings and other materials that are not or were not part of the mud. In an diesel based mud drilling operation, barite becomes entrained in the mud and must be removed. In addition, it must be sampled for the content of low gravity solids and barite to determine if the levels are acceptable or need to be discharged to waste.

It is an object of the present invention to have a simple separation from the mud, the gas, water and materials produced by the well so that the barite is separated from the other components produced or used in the drilling process and are not otherwise dumped into the environment as in the prior art.

SUMMARY OF THE INVENTION

A barite scrubber mud tank is disclosed in which are located blade agitators which rotate clockwise below which are paddle wheel agitators which rotate counter clockwise. The agitators are set such that only the barite, the heaviest sediments, fall below the two sets of agitators. The barite settles into a series of hoppers which discharge at the bottom of the tank by the use of a dump valve located at the bottom of the hopper. The dump valves are controlled by weight sensitive switches set to open the dump valve when the weight of the material in the hopper exceeds normal mud weight. The discharge from the dump valve enters a screw conveyor to an active mud system or to waste.

DESCRIPTION OF THE DRAWINGS

For a further understanding of the nature and objects of the present invention, reference should be had to the following drawing in which like parts are given like reference numerals and wherein:

FIG. 1 is a prospective view of the barite separation mud tank of the preferred embodiment of the present invention.

DESCRIPTION OF THE PREFERRED EMBODIMENT

Mud from an active mud system (not shown) flows through the barite scrubber tank 5 (FIG. 1) to a drilling rig (not shown). Barite scrubber tank 5 can either replace a main mud tank of the prior art or be used as an additional mud cleaning tool. An advantage of barite scrubber tank 5 is that an operator of the drilling rig can sample and discard or retain low gravity solids and barite continuously without interrupting the flow of drilling mud to and from the drilling rig.

Mud (not shown) enters barite scrubber tank 5 at inlet grating 10 from any of various solid control equipment, shale shakers, mud cleaners, or the like (not shown) or an upstream mud tank (not shown). The barite scrubber tank 5 is rectangular in shape with closed, metal walls and an outlet 16. It further has a series of hoppers 12 stationed along the entire rectangular length of the bottom of barite scrubber tank 5. Barite scrubber tank 5 is mounted on a rectangular, lower frame 90 located on the ground (not shown) by vertical members 92 extending from rectangular lower frame 90 that support the body 94 of the barite scrubber tank 5 above rectangular, lower frame 90.

Barite scrubber tank 5 contains blade agitators 11 which rotate clockwise as used in standard mud tanks. Agitators 11 have motors 110 mounted on grating 10. Motors 110 are connected by shafts 115 to agitator blades 120 that rotate clockwise.

Below the level of agitator blades 120 at the entrance of each hopper 12, there is mounted a paddle wheel agitator 13. Paddle wheel agitators 13 include a central shaft 130 and a flanges 135 on each side. A series of paddles 140 are located between the flanges 135 and attached to the shaft 130. Shaft 130 is driven by motors 160 which cause the paddles 140 to rotate in a counter clockwise direction. Paddle wheel agitators 13 maintain circulation of all but the heaviest sediments (not shown) which sediments settle into the hoppers 12. Hoppers 12 are trapezoidal in cross-section each having a cylindrical lower portion 145 which is closed at its lower ends by a dump valve 14. Dump valves 14 have bottom outlets 150 that open to permit hoppers 12 to be discharged by the corresponding automatic dump valves 14. The opening of outlets 150 of these dump valves 14 are individually controlled by weight sensitive switches 17 that open when the weight in the hopper 12 exceeds normal mud weight. The outlets 150 of each dump valve 14 discharges onto a screw conveyer 15, permitting the low gravity solids or barite to be discharged by discharge 155 either to the active mud system or to waste. For this purpose, screw conveyor 15 has diverter slide 18 to route the discharge.

The embodiment set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed as invention is:

1. A scrubber, comprising:

a tank, said tank having an inlet and an outlet and a bottom and an interior;

said bottom including a series of hoppers formed along the length of said bottom;

blade agitators mounted on said tank extending into the interior of said tank above said hoppers;

paddle wheel agitators mounted on said tank and extending into said tank below said blade agitators and at the entrance to said hoppers;

each of said hoppers includes a dump valve;

a conveyor; and each of said dump valves having an outlet opening onto said conveyor.

2. The scrubber of claim 1, wherein said tank is rectangular in shape having closed walls.

3. The scrubber of claim 2, wherein said hoppers are located along substantially the full length of said rectangular shape of said tank.

4. The scrubber of claim 3, wherein there is further included a lower frame, said tank mounted on said lower frame.

5. The scrubber of claim 4, wherein said lower frame is rectangular in shape.

6. The scrubber of claim 5, wherein there is further included legs having space between them, said lower frame supported by and connected to said legs and said hoppers extending into said space between said legs.

7. The scrubber of claim 6, wherein said tank has a top and there is further included grating, said grating located at said top of said tank.

8. The scrubber of claim 7, wherein said blade agitators include first motors, said first motors mounted on said grating.

9. The scrubber of claim 8, wherein said blade agitators include first blades and said first motors having means for driving said first blades to rotate counterclockwise.

10. The scrubber of claim 9, wherein said paddle wheel agitators are rotatably connected to the longitudinal walls of said tank.

11. The scrubber of claim 10, wherein said paddle wheel agitators include second blades and second motors and said second motors have means for rotating said second blades counterclockwise.

12. The scrubber of claim 11, wherein said hoppers are trapezoidal in cross section.

13. The scrubber of claim 12, wherein said hoppers each have a cylindrical lower portion, said dump valves being connected to the end of said cylindrical lower portion.

14. The scrubber of claim 13, wherein each of said dump valves includes a weight sensitive switch connected to open said dump valve.

15. The scrubber of claim 14, wherein said conveyor is a screw conveyor.

16. The scrubber of claim 15, wherein said conveyor includes a diverter at the discharge of said conveyor.

* * * * *